US010041660B2

(12) United States Patent
Harvey

(10) Patent No.: US 10,041,660 B2
(45) Date of Patent: Aug. 7, 2018

(54) HANGING LIGHT

(71) Applicant: Milwaukee Electric Tool Corporation, Brookfield, WI (US)

(72) Inventor: Kyle Harvey, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 106 days.

(21) Appl. No.: 15/091,677

(22) Filed: Apr. 6, 2016

(65) Prior Publication Data

US 2016/0290613 A1 Oct. 6, 2016

Related U.S. Application Data

(60) Provisional application No. 62/143,528, filed on Apr. 6, 2015, provisional application No. 62/187,527, filed on Jul. 1, 2015, provisional application No. 62/187,539, filed on Jul. 1, 2015.

(51) Int. Cl.

| | |
|---|---|
| ***F21V 21/16*** | (2006.01) |
| ***F21S 8/06*** | (2006.01) |
| ***F21S 9/02*** | (2006.01) |
| *F21Y 115/10* | (2016.01) |

(52) U.S. Cl.

CPC ..... *F21V 21/16* (2013.01); *F21S 8/068* (2013.01); *F21S 9/02* (2013.01); *F21Y 2115/10* (2016.08)

(58) Field of Classification Search

CPC .... F21S 8/06; F21S 8/061; F21S 8/068; F21S 8/65; F21S 9/02; F21V 15/01; F21V 21/008; F21V 21/104; F21V 21/112; F21V 21/16; F21V 23/001; F21V 21/00;

(Continued)

(56) References Cited

U.S. PATENT DOCUMENTS

| | | | |
|---|---|---|---|
| 2,627,834 | A | 2/1953 | Roberts et al. |
| 2,836,870 | A | 6/1958 | Shea |
| 3,265,032 | A | 8/1966 | Hume |

(Continued)

FOREIGN PATENT DOCUMENTS

| | | |
|---|---|---|
| GB | 2263726 | 8/1993 |

OTHER PUBLICATIONS

Construction Electrical Products, "LED High Bay Light ", Accessed: Mar. 9, 2016, <http://www.cepnow.com/product/led-high-bay-light/>.

(Continued)

*Primary Examiner* — Hargobind S Sawhney
(74) *Attorney, Agent, or Firm* — Michael Best & Friedrich LLP

(57) ABSTRACT

A portable lighting device includes a body, a lighting unit supported by the body, and a terminal block supported by the body. The terminal block is configured to connect to a power source and provide electrical energy to the lighting unit to illuminate a light emitting diode. The portable lighting device also includes a hanging cable configured to hang the body from a support structure. The hanging cable has a first end secured to the body and a second end portion opposite the first end. The portable lighting device further includes a cable clamp mechanism supported by the body. The cable clamp mechanism engages the second end portion of the hanging cable to allow adjustment of a length of the hanging cable between the first end and the cable clamp mechanism.

18 Claims, 10 Drawing Sheets

(58) Field of Classification Search
CPC ..... F21W 2111/02; F21Y 2101/00; F21Y 2103/10; F21Y 2105/10; F21Y 2115/10
See application file for complete search history.

(56) References Cited

U.S. PATENT DOCUMENTS

| | | | | |
|---|---|---|---|---|
| 3,730,129 | A | 5/1973 | Helms | |
| 3,765,061 | A | 10/1973 | Nash | |
| 3,795,218 | A | 3/1974 | Merry | |
| 4,217,847 | A * | 8/1980 | McCloud | B63B 21/08 114/199 |
| 4,397,253 | A | 8/1983 | Uecker et al. | |
| 4,453,486 | A | 6/1984 | Harken | |
| 4,956,897 | A | 9/1990 | Speedie | |
| 6,234,653 | B1 * | 5/2001 | Karton | A01K 31/19 362/126 |
| 6,517,222 | B1 * | 2/2003 | Orlov | F21S 8/06 248/325 |
| 6,767,117 | B2 * | 7/2004 | De'Armond | F21S 8/033 362/147 |
| 7,287,304 | B2 * | 10/2007 | Zebe, Jr. | A43C 7/04 24/134 P |
| 8,164,237 | B2 | 4/2012 | Wen | |
| 9,033,550 | B1 * | 5/2015 | Tickner | F21S 8/061 362/285 |
| 2007/0139921 | A1 * | 6/2007 | Wu | G08G 1/095 362/240 |
| 2007/0246631 | A1 * | 10/2007 | Brown | F21V 21/104 248/343 |
| 2007/0278376 | A1 * | 12/2007 | Townsend, Jr. | G08G 1/095 248/610 |
| 2009/0290364 | A1 * | 11/2009 | Thomas | F21S 8/06 362/404 |
| 2013/0279180 | A1 * | 10/2013 | Pearson | F21V 21/008 362/371 |
| 2015/0040814 | A1 | 2/2015 | Volkwein | |

OTHER PUBLICATIONS

Garvin Industries, "LED Temporary Job Site Light", Accessed: Mar. 9, 2016, <http://www.garvinindustries.com/lighting/led-temp-lights>.

ProBuilt Lighting, "Hang-A-Light LED", Accessed: Mar. 9, 2016, <http://probuiltlighting.com/products/hang-a-light-led/>.

ProBuilt Lighting, "Hang-A-Light 200 Watt LED", Accessed: Mar. 9, 2016, <http://probuiltlighting.com/hal-200-watt-led/>.

* cited by examiner

HANGING LIGHT

CROSS-REFERENCE TO RELATED APPLICATIONS

This application claims priority to U.S. Provisional Patent Application No. 62/143,528 filed on Apr. 6, 2015, U.S. Provisional Patent Application No. 62/187,527 filed on Jul. 1, 2015 and U.S. Provisional Patent Application No. 62/187,539 filed on Jul. 1, 2015, the entire contents of which are incorporated herein by reference.

FIELD OF THE INVENTION

The present invention relates to portable lighting devices and, more particularly, to hanging lights.

SUMMARY OF THE INVENTION

The present invention provides, in one aspect, a portable lighting device including a body and a lighting unit supported by the body. The lighting unit includes a light emitting diode. The portable lighting device also includes a terminal block supported by the body. The terminal block is configured to connect to a power source and provide electrical energy to the lighting unit to illuminate the light emitting diode. The portable lighting device further includes a hanging cable configured to hang the body from a support structure. The hanging cable has a first end secured to the body and a second end portion opposite the first end. The portable lighting device also includes a cable clamp mechanism supported by the body. The cable clamp mechanism engages the second end portion of the hanging cable to allow adjustment of a length of the hanging cable between the first end and the cable clamp mechanism.

The present invention provides, in another aspect, a portable lighting device including a body having an interior cavity and a lighting unit supported by the body. The lighting unit includes a light emitting diode. The portable lighting device also includes a terminal block supported within the interior cavity of the body. The terminal block is configured to connect to a power source and provide electrical energy to the lighting unit to illuminate the light emitting diode. The portable lighting device further includes a port formed in the body in communication with the interior cavity. The port is configured to allow an electrical wire to pass into the interior cavity to couple the electrical wire to the terminal block. The portable lighting device also includes a wire clamp supported by the body at the port. The wire clamp is selectively movable relative to the body to engage the electrical wire passing through the port. The portable lighting device further includes a hanging cable coupled to the body. The hanging cable is configured to hang the body from a support structure.

The present invention provides, in yet another aspect, a portable lighting device including a body having base with an interior cavity, a cover movably coupled to the base to selectively provide access to the interior cavity, and an annular rim supported by the cover above the base. The annular rim defines an opening. The portable lighting device also includes a lighting unit supported by the body. The lighting unit includes a light emitting diode. The portable lighting device further includes a lens coupled to the base of the body and surrounding the lighting unit. The lens has a lower portion opposite from the body. The lower portion has a similar shape and size as the opening defined by the annular rim such that the portable lighting device can be stacked on another portable lighting device. The portable lighting device also includes a terminal block supported within the interior cavity of the body. The terminal block is configured to connect to a power source and provide electrical energy to the lighting unit to illuminate the light emitting diode. The portable lighting device further includes a hanging cable coupled to the body. The hanging cable is configured to hang the body from a support structure.

Other features and aspects of the invention will become apparent by consideration of the following detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

FIGS. 1-10 illustrate a portable lighting device 10, such as a high bay light or work light used at construction sites. The illustrated lighting device 10 includes a lighting unit 20, a lens 50, and a body 100. The lighting device 10 is designed to be portable and optionally includes features to allow a user to hang the lighting device 10 from another object, such as an overhead beam, rafter, or pipe.

Figure 1:
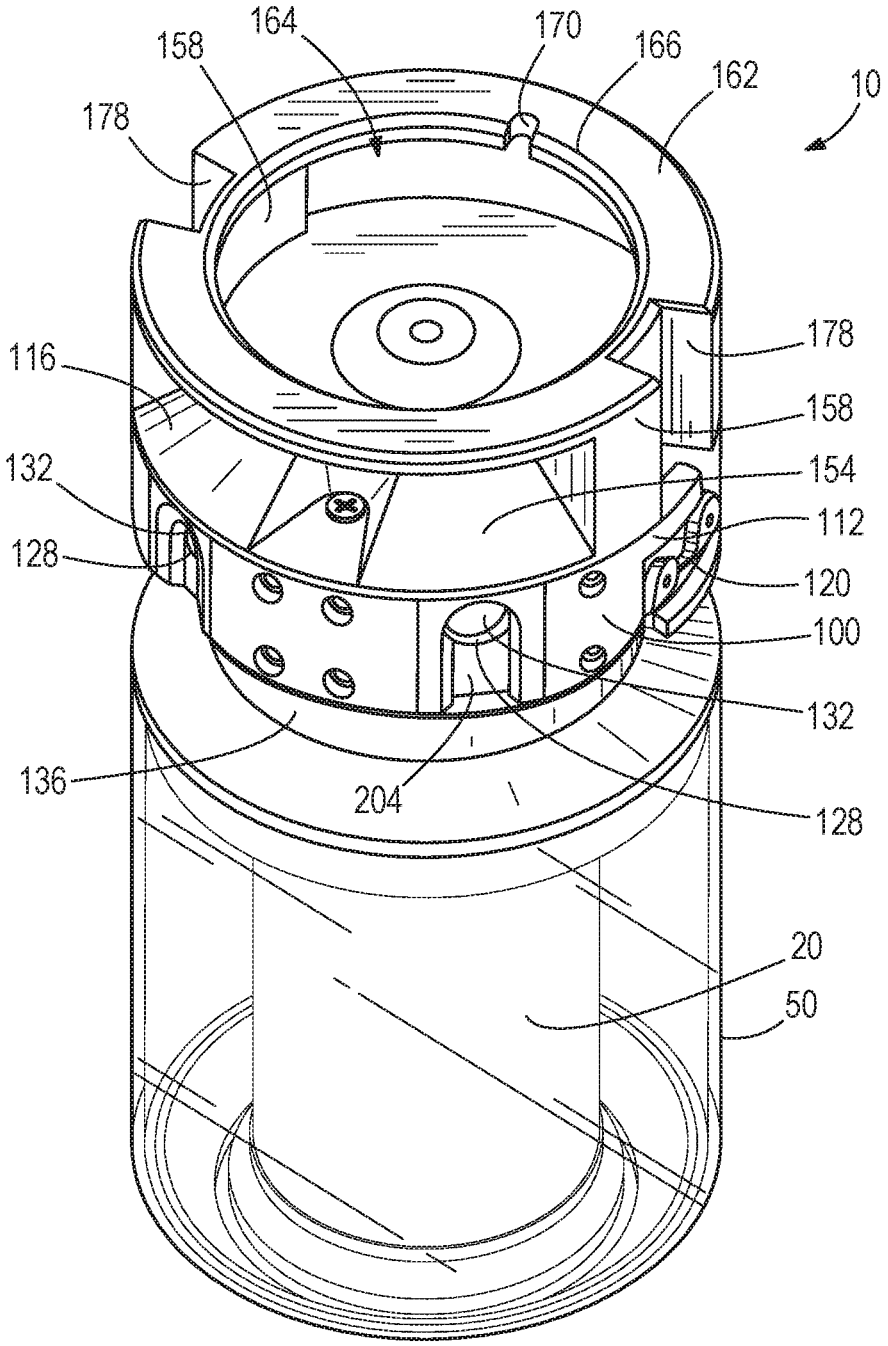
FIG. 1 is a perspective view of a portable lighting device.
Figure 3:
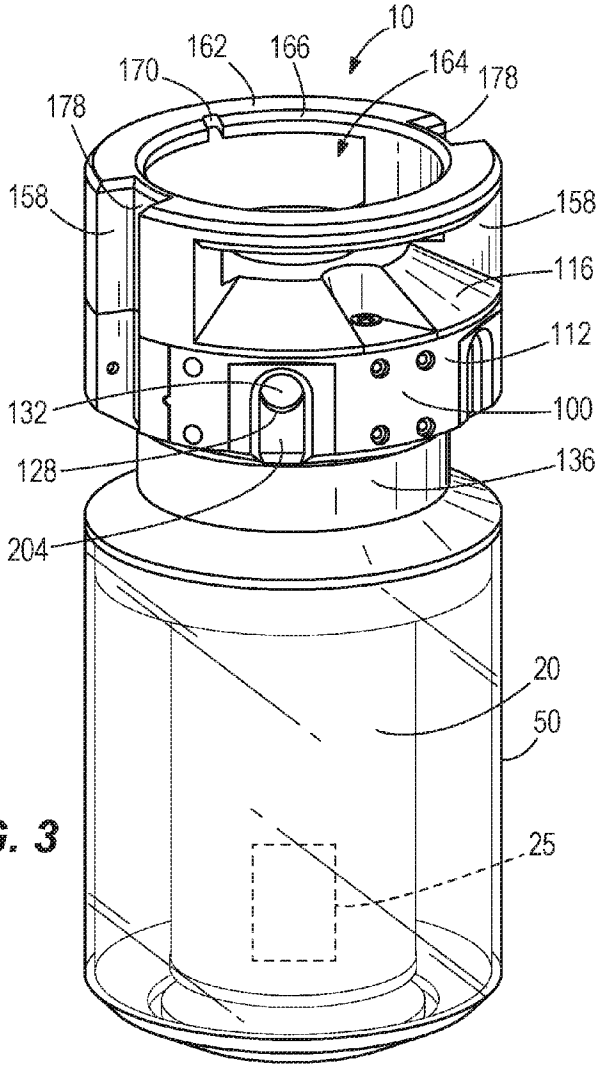
FIG. 3 is another perspective view of the portable lighting device.
Figure 2:
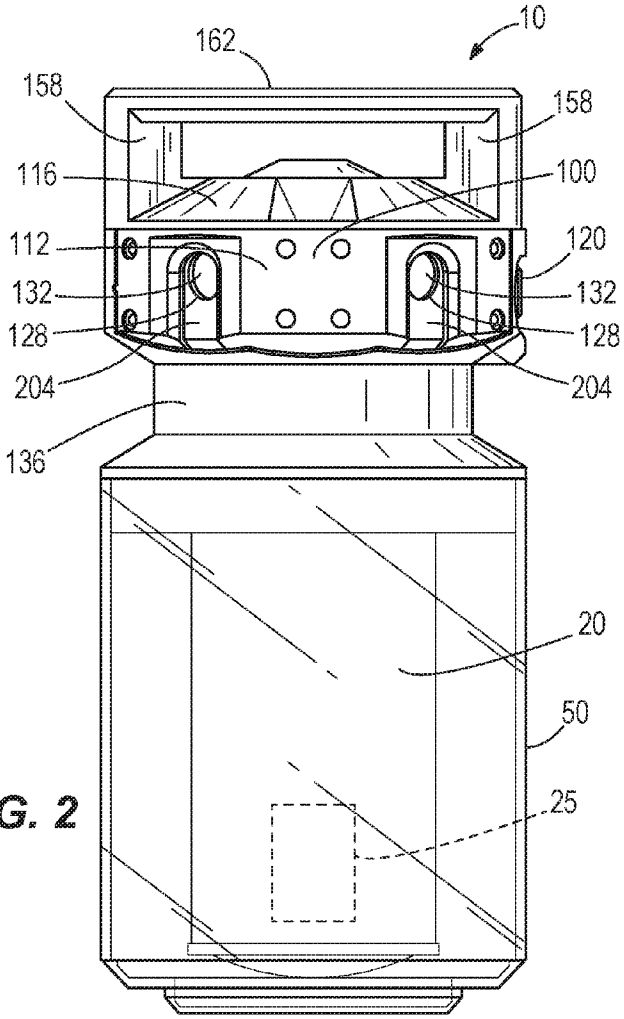
FIG. 2 is a first side view of the portable lighting device.
Figure 4:
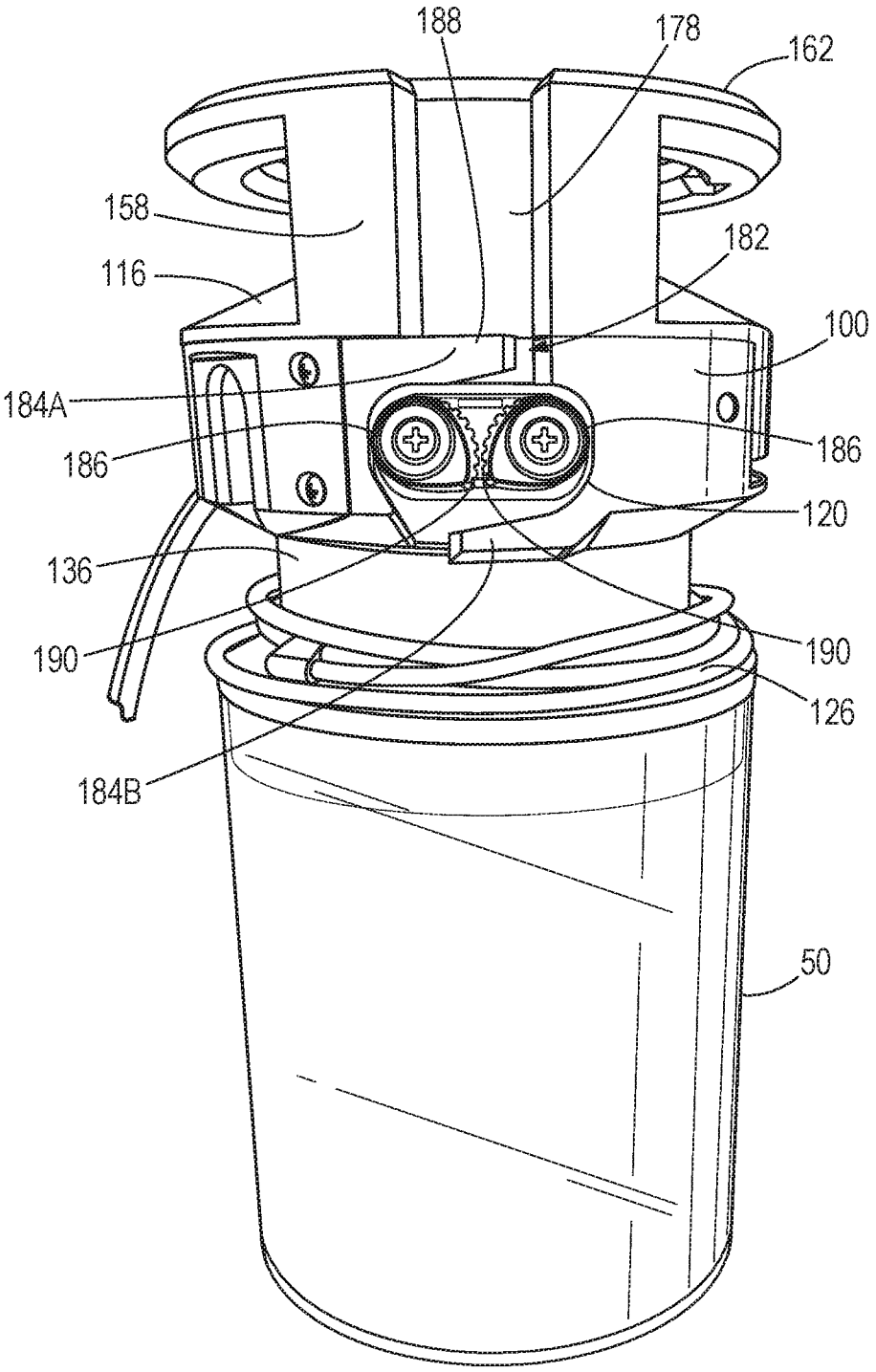
FIG. 4 is a second side view of the portable lighting device.
Figure 5:
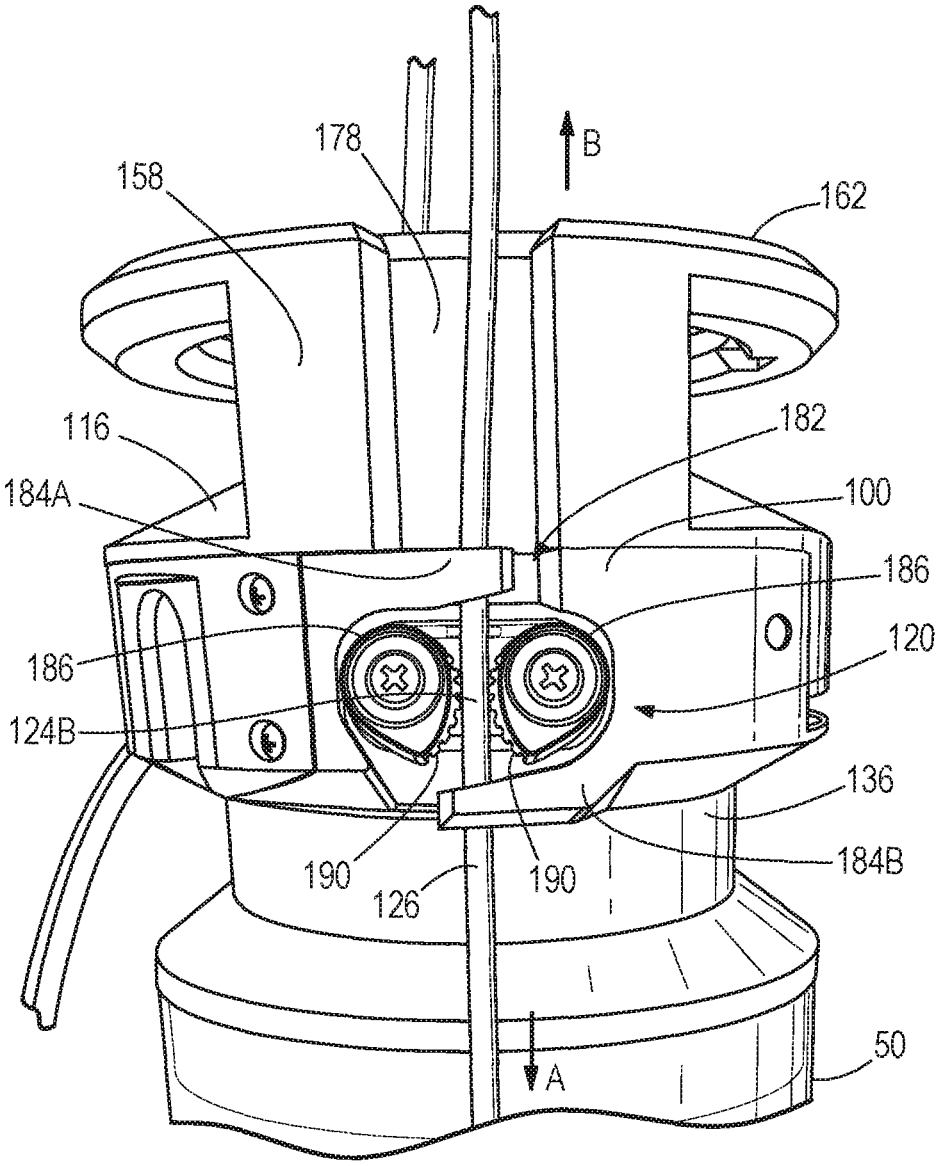
FIG. 5 is an enlarged side view of a portion of the portable lighting device.

The lighting unit 20 is supported by the body 100. As shown in FIGS. 1-3, the lighting unit 20 extends downwardly from the body 100 in an axial direction. In the illustrated embodiment, the lighting unit 20 includes a plurality of light emitting diodes (LEDs) 25, which may optionally be disposed along a plurality of LED strips. In other embodiments, the LEDs 25 of the lighting unit may be arranged in other configurations, or the lighting unit 20 may include a single LED.

With continued reference to FIGS. 1-3, the lens 50 is coupled to the body 100 and surrounds the lighting unit 20. In the illustrated embodiment, the lens 50 and the body 100 completely enclose the lighting unit 20. In other embodiments, the lens 50 may include gaps or apertures such that the lighting unit 20 is not completely enclosed. The lens 50 contains and protects the lighting unit 20, while also acting to diffuse light emitted by the lighting unit 20. In some embodiments, the lens 50 is constructed from a plastic, such as high density polyethylene (HDPE). In other embodiments, the lens 50 may be constructed from other materials (e.g., different plastics, glass, etc.). The lens 50 is also detachably coupled to the body 100, allowing the lens 50 to be easily cleaned and/or replaced. In some embodiments, the lens 50 may be threadably coupled to the body 100. In other embodiments, the lens 50 may be detachably coupled to the body 100 in other suitable manners (e.g., press fitting, detents, bayonet couplings, etc.).

Figure 9:
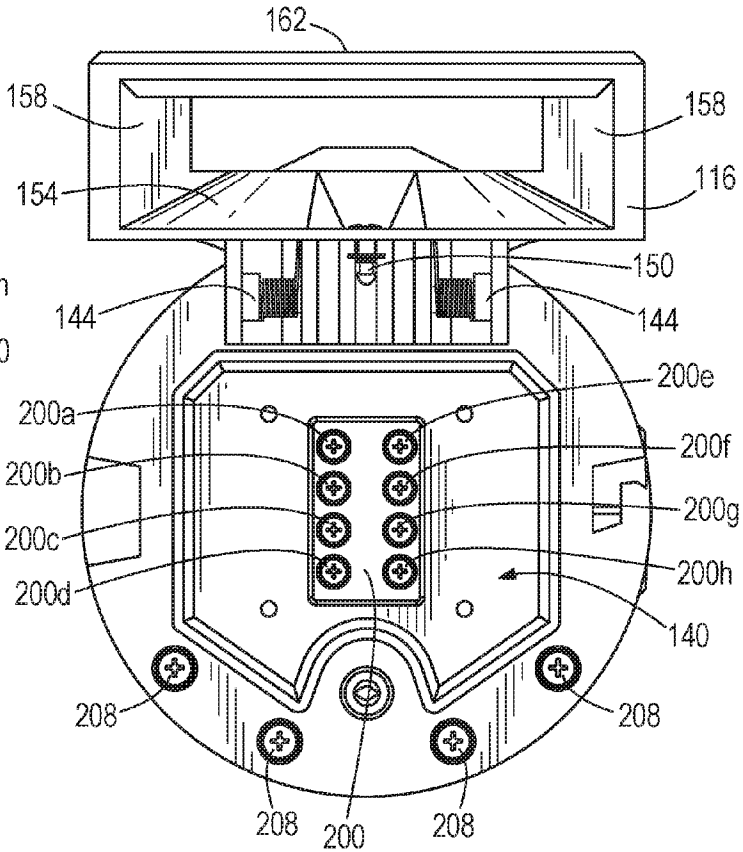
FIG. 9 is a top view of the body of the portable lighting device with the cover in the open position.
Figure 8:
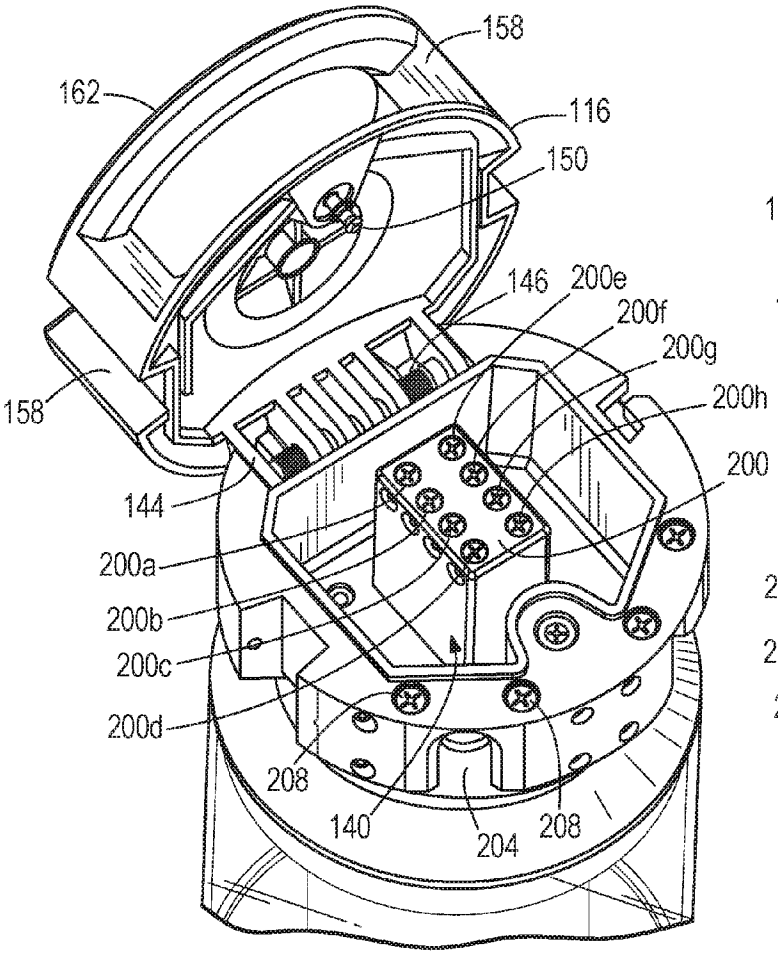
FIG. 8 is a top perspective view of a body of the portable lighting device with a cover in an open position.

The illustrated body 100 is generally cylindrically-shaped and includes a base 112, a cover 116, and an annular rim 162. The base 112 is coupled to the lens 50. The base 112 includes a reduced diameter portion 136, or neck, between the cover 116 and the lens 50. The reduced diameter portion 136 allows an excess length of hanging cable or electrical wire to be wrapped and stored around the body 100. As shown in FIGS. 8 and 9, the base 112 also has an interior cavity 140 that receives a terminal block 200. Two ports 128 (FIG. 2) are formed in the base 112 in communication with the interior cavity 140. As further described below, the ports 128 allow electrical wires to pass into the interior cavity 140 to couple to the terminal block 200.

The cover 116 is movably coupled to the base 112 for movement between a closed configuration (FIGS. 1-3) and an open configuration (FIGS. 8-9). The cover 116 encloses the interior cavity 140 of the base 112 when in the closed configuration. As shown in FIGS. 8 and 9, the cover 116 is pivotally coupled to the base 112 by a hinge 144. The hinge 144 allows the cover 116 to pivot to the open configuration. In some embodiments, such as the illustrated embodiment, the cover 116 is biased to the open configuration by one or more springs 146 (e.g., torsion springs). However, the cover 116 also includes a locking mechanism 150 to maintain the cover 116 in the closed configuration against the bias of the spring(s) 146. In the illustrated embodiment, the locking mechanism 150 includes a quarter-turn fastener that may be rotated by a user with, for example, a screw driver to unsecure the locking mechanism 150 from the base 112. In other embodiments, other types of detachable coupling mechanisms (e.g., push button latches, ball detents, etc.) that may or may not require tools to actuate may alternatively be used to hold the cover 116 in the closed configuration. In some embodiments, a gasket may be positioned between the cover 116 and the base 112 to seal the interior cavity 140 when the cover 116 is closed.

Figure 13:
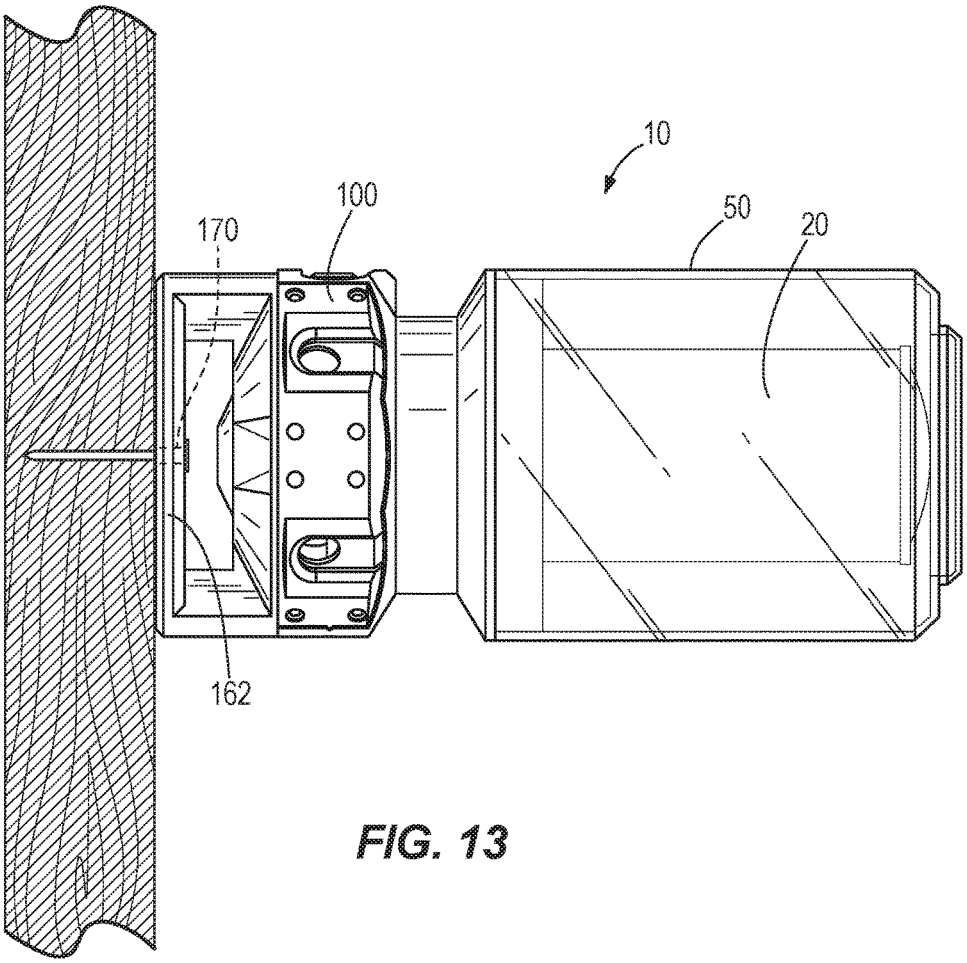
FIG. 13 illustrates the portable lighting device secured to a vertical support.

As shown in FIGS. 1-3, the annular rim 162 is supported by the cover 116 above the base 112. In the illustrated embodiment, two posts 158 extend upwardly from the cover 116 to support the rim 162. The annular rim 162 defines a generally circular opening 164 in the body 100. The rim 162 has a chamfered interior edge 166 that defines the opening 164. The rim 162 also includes a notch 170 formed in the interior edge 166. The notch 170 is configured to receive a fastener, such as a nail, to hang the lighting device 10 from a support structure, such as a wall. When secured to a vertical support surface, as shown in FIG. 13, the lighting device 10 extends laterally outward such that the lighting unit 20 extends parallel to the ground. Referring back to FIGS. 1 and 3, the annular rim 162 also includes two channels 178 formed in an outer surface of the rim 162. The channels 178 extend continuously through the posts 158 and an outer surface of the cover 116. As further explained below, the channels 178 are configured to receive portions of a hanging cable to help guide the cable.

Figure 12:
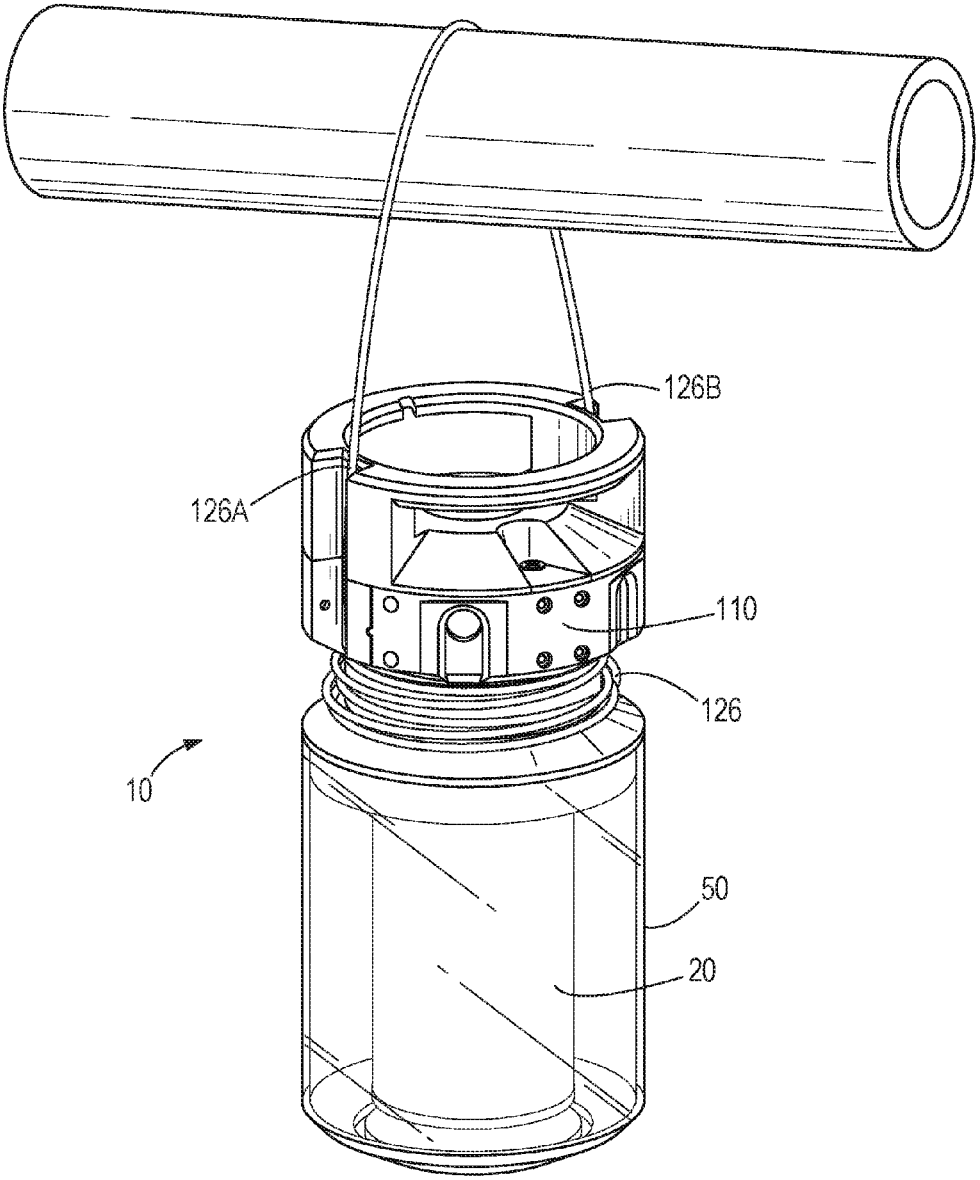
FIG. 12 illustrates the portable lighting device hanging from an overhead support.

As shown in FIGS. 4-7, the illustrated lighting device 10 includes a hanging cable 126 coupled to the body 100. The hanging cable 126 is configured to hang the lighting device 10 from a support structure, such as an overhead beam, rafter, or pipe (FIG. 12). The hanging cable 126 includes a first end 126A (FIG. 12) that is secured to the body 100 by a pin, rivets, a hook, or the like. The hanging cable 126 also includes a second end portion 126B opposite from the first end 126A. The second end portion 126B is adjustably coupled to a cable clamp mechanism 120 of the lighting device 10. The cable clamp mechanism 120 is supported by the body 100 at a location diametrically opposite from where the first end 126A of the cable 126 is secured to the body 100. In particular, the cable clamp mechanism 120 is aligned with one of the channels 178, and the first end 126A of the cable 126 is secured in the other channel 178. This arrangement allows the hanging cable 126 to be extended over the cover 116 to form a loop for hanging the lighting device 10. The cable clamp mechanism 120 also allows the length of the cable 126 between the secured first end 126A and the cable clamp mechanism 120 to be adjusted (e.g., increased or decreased) by pulling the second end portion 126B of the cable 126 through or releasing the second end portion 126B of the cable 126 from the clamp mechanism 120. Adjusting the length of the cable 126 changes the size of the loop formed by the hanging cable 126. Excess length of the hanging cable 126 can be wrapped around the reduced diameter portion 136 of the base 112 for storage.

Figure 6:
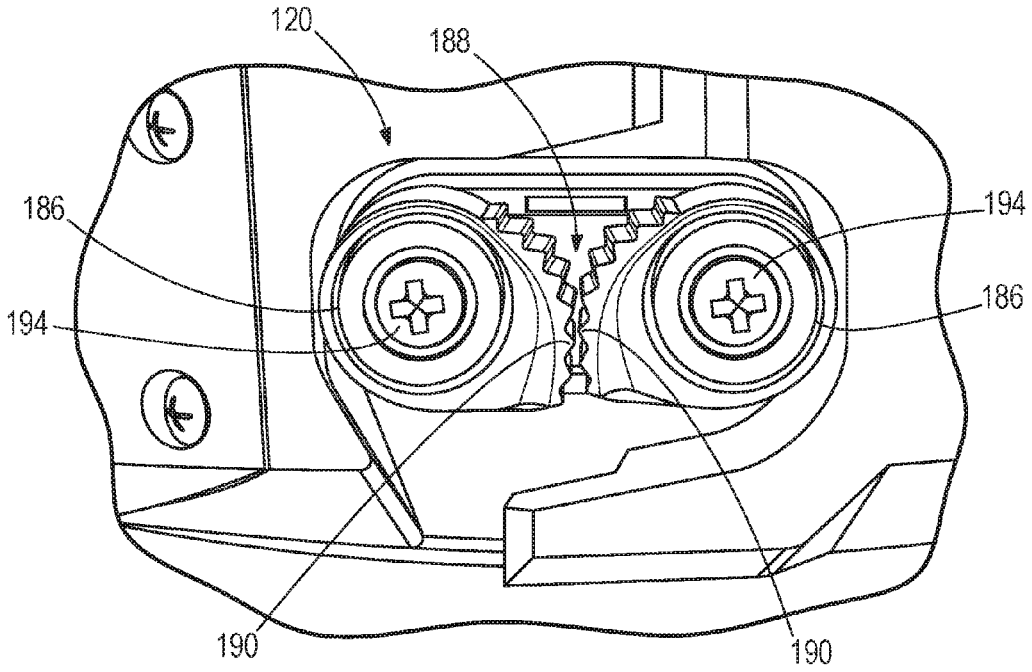
FIG. 6 is an enlarged view of a cable clamp mechanism of the portable lighting device in a locked configuration.
Figure 7:
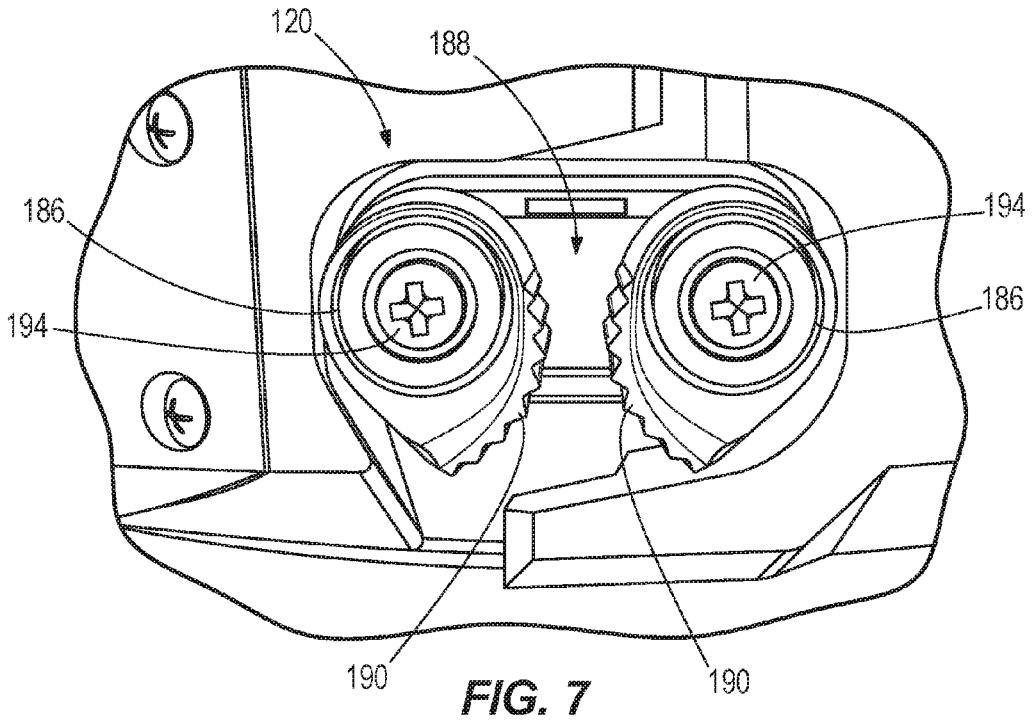
FIG. 7 is an enlarged view of the cable clamp mechanism in an unlocked configuration.

As shown in FIGS. 6 and 7, the illustrated cable clamp mechanism 120 includes two spaced apart, rotatable cam members 186. Each cam member 186 includes a toothed gripping surface 190. A gap 188 is defined between the cam members 186 for receiving the hanging cable 126. The cam members 186 are rotatable between a locked configuration (FIG. 6), in which the toothed gripping surfaces 190 protrude into the gap 188 to engage the hanging cable 126, and an unlocked configuration (FIG. 7), in which the toothed gripping surfaces 190 are moved at least partially out of the gap 188 to release the hanging cable 126 and allow adjustment of the hanging cable 126. In the illustrated embodiment, the cam members 186 are supported by and rotatable about posts 194 (e.g., threaded fasteners) secured to the body 100. The illustrated cam members 186 are also rotatably biased to the locked configuration by torsion springs positioned between the posts 194 and the cam members 186. In other embodiments, the cam members 186 may be biased by other suitable types of spring members toward the locked configuration.

Referring back to FIGS. 4 and 5, the body 100 includes a retention member 182 disposed adjacent the cable clamp mechanism 120. The illustrated retention member 182 includes a first tab 184A positioned on one side (e.g., above) the cable clamp mechanism 120 and a second tab 184B positioned on an opposite side (e.g., below) the cable clamp mechanism 120. The tabs 184A, 184B extend over and across the channel 178. The hanging cable 126 is threaded between the body 100 and the first tab 184A, through the cable clamp mechanism 120, and between the body 100 and the second tab 184B. The tabs 184A, 184B engage sections of the cable 126 above and below the cable clamp mechanism 120 to constrain movement of the cable 126 away from the body 100, thereby helping retain the cable 126 within the cable clamp mechanism 120.

In operation, the hanging cable 126 is placed between the cam members 186 such that a desired length of cable 126 passes over the cover 116. The cable 126 is retained by the toothed gripping surfaces 190 of the cam members 186 within the gap 188. The cam members 186 allow the cable 126 to be pulled in one direction through the cable clamp mechanism 120, but not in the opposite direction. For example, if the cable 126 is pulled in the direction of arrow A, the cam members 186 can be momentarily displaced against their bias to allow the cable 126 to pass through the clamp mechanism 120 and, thereby, decrease the size of the loop formed by the cable 126. However, if the cable 126 is pulled in the direction of arrow B, the cam members 186 seize the cable 126, inhibiting the cable 126 from being pulled further through the clamp mechanism 120. It should be apparent that the direction of arrow B is the same as a force vector resulting from hanging the lighting device 10 via the cable 126, and that the clamp mechanism 120 thereby inhibits the cable 126 from being pulled out of the clamp mechanism 120 due to the weight of the lighting device 10 itself. In order to pull the hanging cable 126 in the direction of arrow B (and increase the size of the loop formed by the cable 126), a user can use his/her finger or a tool to temporarily pivot one or both of the cam members 186 against its bias.

Figure 10:
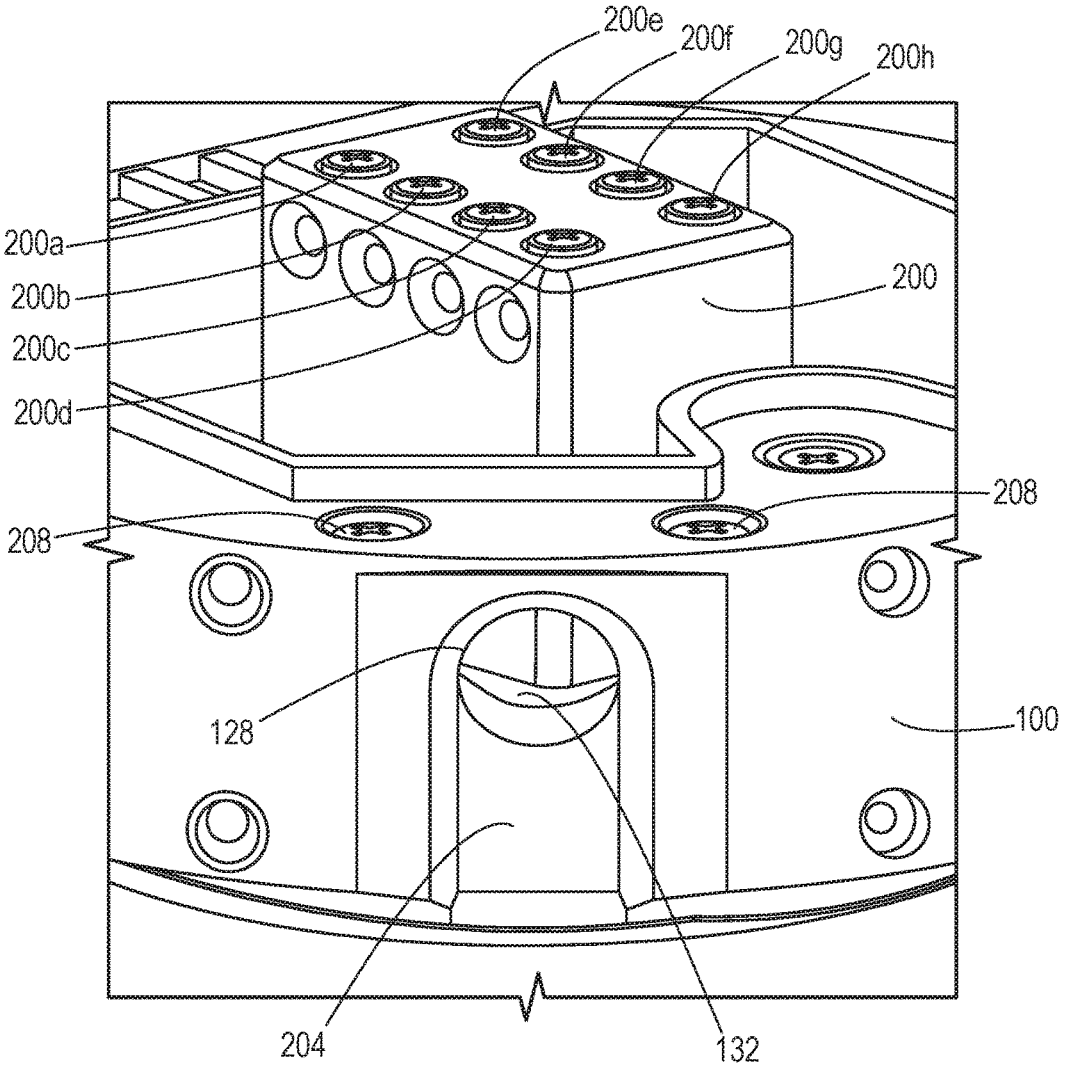
FIG. 10 is an enlarged perspective view of a terminal block of the portable lighting device.

FIGS. 8-10 illustrate the cover 116 in an open configuration to expose the terminal block 200. The terminal block 200 includes a plurality of screw terminals for connecting electrical wires to the lighting device 10. In the illustrated embodiment, the terminal block 200 includes eight terminals 200*a-h* arranged as two sets of four terminals. One set of terminals 200*a-c* acts as a power input, and includes a power in terminal 200*a*, a ground terminal 200*b*, and neutral terminal 200*c*. These terminals 200*a-c* are electrically coupled to an external power source via electrical wires and to the lighting unit 20 to power the LEDs 25. The other set of terminals 200*e-g* acts as a power output, and includes a power out terminal 200*e*, a ground terminal 200*f*, and a neutral terminal 200*g*. These terminals 200*e-g* allow a peripheral device, such as another portable lighting device, to be electrically coupled to and draw power from the lighting device 10. As such, multiple portable lighting devices 10 can be connected, or daisy-chained, together to form a string of lights that receive power from the same external power source.

The illustrated terminal block 200 also includes two pass-through screw terminals—an input terminal 200*d* and an output terminal 200*h*. The pass-through terminals 200*d*, 200*h* are configured to receive power from the external power source or a second external power source, and pass electricity through the terminal block 200. That is, electricity is passed directly through the lighting device 10 without being consumed or attenuated by the lighting device 10 (e.g., to power the lighting unit 20, etc.). Sufficient power can thereby be provided to downstream lights by the pass-through terminals 200*d*, 200*h* if, for example, many lights are strung together. Accordingly, one or more peripheral devices (including additional portable lighting units 10) may be connected to the lighting device 10 via either the output terminals 200*e-g* or the pass-through terminals 200*d*, 200*h*.

In one example, a plurality of lighting devices 10 may be electrically connected to a common power source via terminal blocks 200 disposed in each lighting device 10. If the first lighting device 10 is coupled to the external power source, and each subsequent lighting device 10 is coupled to the output terminals of an adjacent device 10, the number of lights that may be connected in series is limited by the power usage of each upstream device 10. In order to overcome this power consumption, the pass-through terminals 200*d*, 200*h* transfer power without significant usage or attenuation. Accordingly, a greater number of lighting devices 10 and/or other peripheral devices may be coupled in series.

Referring back to FIGS. 1-3, the illustrated lighting device 10 includes two wire clamps 132 supported by the body 100 at the ports 128. The wire clamps 132 help secure the electrical wires to the lighting device 10, inhibiting the wires from being unintentionally pulled out of the terminal block 200. One of the ports 128 and clamps 132 are associated with the input terminals 200*a-d*, and the other port 128 and clamp 132 are associated with the output terminals 200*e-h*. Each clamp 132 is associated with one of the ports 128 and includes a door 204. The doors 204 are movable (e.g., slidable) relative to the body 100 to open and close the ports 128. When the doors 204 are opened, the electrical wires may be inserted through or pulled out of the ports 128. When the doors 204 are closed, the doors 204 engage the electrical wires to hold the wires in place, thereby inhibiting disconnection of the wires from the terminal block 200.

Each wire clamp 132 also includes an adjustment member 208 coupled to the door 204. The adjustment member 208 is actuatable to move the door 204 relative to the body 100. As shown in FIGS. 8 and 9, the illustrated adjustment members 208 are screws that are operatively coupled to the doors 204. The screws 208 are rotatable to move the doors 204 up and down. In the illustrated embodiment, two screws 208 are associated with each door 204, and both screws 208 are rotated to move the door 204. In other embodiments, only one screw 208 may be used to move each door 204. In further embodiments, other types of mechanisms may be used for moving the doors 204 relative to the body 100. For example, the doors 204 may be spring-biased closed and manually moved open, the doors 204 may be associated with switches that change their positions, or the doors 204 may include detents to hold the doors open and closed with handles to manually move the doors 204.

Figure 11:
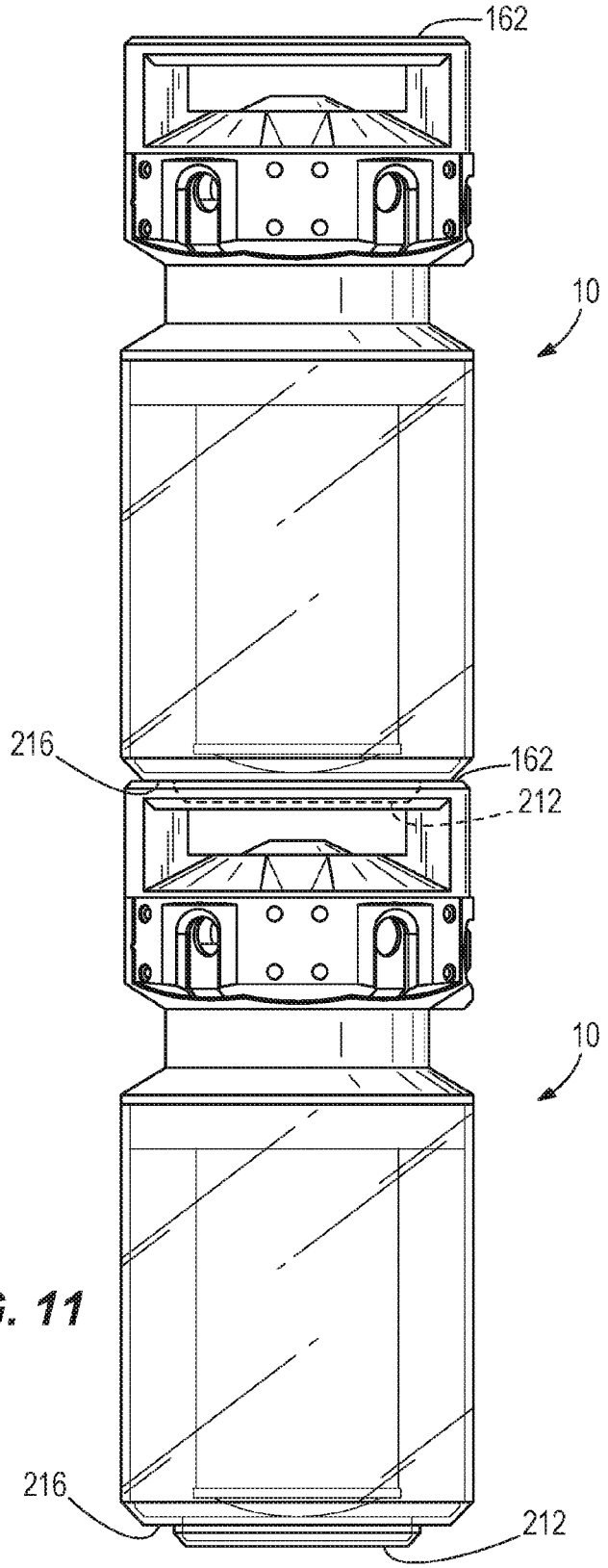
FIG. 11 is a side view of two, stacked portable lighting devices.

As shown in FIG. 11, the lens 50 includes a lower portion 212 formed on a bottom of the lens 50 opposite from the body 100. The lower portion 212 is a boss or projection having a similar shape and size as the opening 164 defined by the annular rim 162. In addition, the lower portion 212 has a chamfered exterior edge 216 corresponding to the chamfered interior edge 166 of the annular rim 162. In this way, the lower portion 212 of the lens 50 of a first lighting device 10 may be received and seated in the opening 164 of a second lighting device 10 so that multiple lighting devices 10 may be stacked upon one another. The chamfered edges 166, 216 help the lighting devices 10 seat snugly on top of each other.

In operation, the device 10 may be hung on or otherwise connected to an external structure via the hanging cable 126 or notch 170. The lighting device 10 is also electrically coupled to a power source, such as a standard 120V power outlet, via electrical wires to power the LEDs 25 of the lighting unit 20. The light emitted by the LEDs 25 passes through the lens 50, which diffuses light to provide light to a larger area and to provide more uniform lighting. Furthermore, additional lighting devices, or other peripheral devices, may be coupled to the lighting device 10 via the power outlet or the pass-through terminals as described above.

Although the invention has been described in detail with reference to certain preferred embodiments, variations and modifications exist within the scope and spirit of one or more independent aspects of the invention as described.

What is claimed is:

1. A portable lighting device comprising:

a body;

a lighting unit supported by the body, the lighting unit including a light emitting diode;

a terminal block supported by the body, the terminal block configured to connect to a power source and provide electrical energy to the lighting unit to illuminate the light emitting diode;

a hanging cable configured to hang the body from a support structure, the hanging cable having a first end secured to the body and a second end portion opposite the first end; and a cable clamp mechanism supported by the body, the cable clamp mechanism engaging the second end portion of the hanging cable to allow adjustment of a length of the hanging cable between the first end and the cable clamp mechanism;

wherein the body further includes a retention member disposed adjacent the cable clamp mechanism, where the retention member constrains movement of the hanging cable away from the body to retain the hanging cable within the cable clamp mechanism;

wherein the retention member includes a first tab positioned on one side of the cable clamp mechanism and a second tab positioned on an opposite side of the cable clamp mechanism, and wherein the hanging cable is threaded between the body and the first tab, through the cable clamp mechanism, and between the body and the second tab.

2. The portable lighting device of claim 1, wherein the cable clamp mechanism is supported on an outer surface of the body.

3. The portable lighting device of claim 1, wherein the cable clamp mechanism includes a pair of rotatable cams having toothed gripping surfaces that are spaced apart to define a gap for receiving the hanging cable.

4. The portable lighting device of claim 3, wherein each rotatable cam is rotatable between a locked configuration, in which the toothed gripping surface protrudes into the gap to engage the hanging cable, and an unlocked configuration, in which the toothed gripping surface releases the hanging cable to allow adjustment of the hanging cable.

5. The portable lighting device of claim 4, wherein each rotatable cam is biased toward the locked configuration, and wherein the pair of rotatable cams allows the length of the hanging cable to be shortened, but not lengthened.

6. A portable lighting device comprising:

a body having an interior cavity;

a lighting unit supported by the body, the lighting unit including a light emitting diode;

a terminal block supported within the interior cavity of the body, the terminal block configured to connect to a power source and provide electrical energy to the lighting unit to illuminate the light emitting diode;

a port formed in the body in communication with the interior cavity, the port configured to allow an electrical wire to pass into the interior cavity to couple the electrical wire to the terminal block;

a wire clamp supported by the body at the port, the wire clamp being selectively movable relative to the body to engage the electrical wire passing through the port; and a hanging cable coupled to the body, the hanging cable configured to hang the body from a support structure.

7. The portable lighting device of claim 6, wherein the terminal block includes a power input terminal for providing electricity to the lighting unit, a power output terminal for outputting electricity that has passed through the lighting unit, and a ground terminal.

8. The portable lighting device of claim 7, wherein the terminal block also includes a pass-through terminal, and wherein the pass-through terminal transfers electricity through the terminal block without providing the electricity to the lighting unit.

9. The portable lighting device of claim 6, wherein the port is a first port and the wire clamp is a first wire clamp, and further comprising:

a second port defined in the body in communication with the interior cavity and spaced apart from the first port, the second port configured to allow another electrical wire to pass into the interior cavity to couple the another electrical wire to the terminal block; and a second wire clamp supported by the body at the second port, the second wire clamp being selectively movable relative to the body to engage the another electrical wire passing through the second port.

10. The portable lighting device of claim 6, wherein the wire clamp includes a door that selectively covers the port and an adjustment member operatively coupled to the door, and wherein the adjustment member is actuatable to move the door relative to the body.

11. The portable lighting device of claim 10, wherein the adjustment member includes a threaded fastener.

12. The portable lighting device of claim 6, wherein the body includes a base and a cover pivotally coupled to the base to provide access to the interior cavity.

13. The portable lighting device of claim 12, wherein the cover includes a locking mechanism that engages the base to maintain the cover in a closed configuration.

14. A portable lighting device comprising:

a body including a base having an interior cavity, a cover movably coupled to the base to selectively provide access to the interior cavity, and an annular rim supported by the cover above the base, the annular rim defining an opening;

a lighting unit supported by the body, the lighting unit including a light emitting diode;

a lens coupled to the base of the body and surrounding the lighting unit, the lens having a lower portion opposite from the body, the lower portion having a similar shape and size as the opening defined by the annular rim;

a terminal block supported within the interior cavity of the body, the terminal block configured to connect to a power source and provide electrical energy to the lighting unit to illuminate the light emitting diode; and a hanging cable coupled to the body, the hanging cable configured to hang the body from a support structure.

15. The portable lighting device of claim 14, wherein the rim has a chamfered interior edge that defines the opening, and wherein the lower portion of the lens has a chamfered exterior edge that corresponds to the chamfered interior edge.

16. The portable lighting device of claim 14, wherein the annular rim includes a notch configured to receive a fastener to support the portable lighting device on a vertical support structure.

17. The portable lighting device of claim 14, wherein the cover includes a post that supports the annular rim apart from the cover.

18. The portable lighting device of claim 14, wherein the lens is a solid member made of a plastic material.

* * * * *